US005639411A

United States Patent [19]

Wilkins et al.

[11] Patent Number: 5,639,411

[45] Date of Patent: Jun. 17, 1997

[54] PROCESS FOR EXPANDING GLASS FIBER LAMINATES AND PANELS FORMED THEREBY

[75] Inventors: Rodney R. Wilkins, Granville, Ohio; Carl J. Weaver, Waco, Tex.; Donald E. Dickson, Junction City, Ohio

[73] Assignee: Holli-Nee Corporation, Del.

[21] Appl. No.: 361,187

[22] Filed: Dec. 21, 1994

[51] Int. Cl.[6] ..... B28B 11/16; B29C 37/00; D21J 3/00; D02J 1/06

[52] U.S. Cl. ..... 264/145; 264/160; 264/231; 264/324; 264/288.4; 264/288.8; 264/DIG. 73

[58] Field of Search ..... 264/136, 137, 264/231, 324, 288.4, 288.8, DIG. 73, 160, 145

[56] References Cited

U.S. PATENT DOCUMENTS

| | | | |
|---|---|---|---|
| 1,904,268 | 4/1933 | Bronson | 264/324 |
| 2,546,230 | 3/1951 | Modigliani | 154/92 |
| 2,609,320 | 9/1952 | Modigliani | 154/90 |
| 2,644,780 | 7/1953 | Simkins et al. | 154/92 |
| 2,964,439 | 12/1960 | Modigliani | 154/90 |
| 2,984,286 | 5/1961 | Copenhefer | 154/1 |
| 3,054,714 | 9/1962 | Johnston | 156/212 |
| 3,072,513 | 1/1963 | Schlarb | 154/54 |
| 3,092,533 | 6/1963 | Beckner | 156/167 |
| 3,226,458 | 12/1965 | Graff et al. | 264/555 |
| 3,230,287 | 1/1966 | Caron et al. | 264/120 |
| 3,583,030 | 6/1971 | Terry et al. | 18/4 |
| 3,615,149 | 10/1971 | Malone et al. | 264/324 |
| 3,765,998 | 10/1973 | Oswald et al. | 264/324 |
| 3,865,540 | 2/1975 | Loeffler | 432/2 |
| 4,038,356 | 7/1977 | Beranek, Jr. et al. | 264/160 |
| 4,508,673 | 4/1985 | Stahl et al. | 264/324 |
| 4,515,848 | 5/1985 | Levnig et al. | 264/324 |
| 4,609,519 | 9/1986 | Pichard et al. | 264/510 |
| 4,882,114 | 11/1989 | Radvan et al. | 264/129 |
| 4,942,081 | 7/1990 | Reiniger | 264/324 |

*Primary Examiner*—Jan H. Silbaugh
*Assistant Examiner*—Robin S. Gray
*Attorney, Agent, or Firm*—Kremblas, Foster, Millard & Pollick; Sidney W. Millard

[57] ABSTRACT

A condensed mat of glass fibers incorporating a thermosetting resin is expanded over a mold. Gripping elements at the edges of the mold hold the edges of the expanded mat in place while a second mold confines and deforms the expanded mat between the two molds. Hot air is passed through the porous molds and through the expanded mat to set the thermosetting resin which thereby holds the expanded mat in its deformed shape to form a panel.

8 Claims, 3 Drawing Sheets

PROCESS FOR EXPANDING GLASS FIBER LAMINATES AND PANELS FORMED THEREBY

FIELD OF THE INVENTION

This invention relates to expanding or stretching condensed mats of glass fibers and deforming the same to provide a formed panel of glass fibers.

BACKGROUND OF THE INVENTION

Technology for making a condensed mat of glass fiber strands is well known in the art and the system is described fairly well in several patents to Modigliani, U.S. Pat. Nos. 2,546,230; 2,609,320 and 2,964,439. Each of the patents describes a melting furnace feeding molten glass to spinning orifices which discharge fine glass fibers, which in turn are wrapped circumferentially around a spinning drum. During the deposition of the fibers on the rotating drum, a thermosetting resin is applied to the surface to hold the fibers at their overlapping junctions between layers.

Ordinarily the furnace and spinning orifices move longitudinally along the rotating drum during the assembly process. The translation of the furnace with respect to the drum is relatively slow and the drum is rotating relatively fast to provide a build-up of a plurality of layers of the glass fibers.

After a suitable thickness of fibers has been created, the condensed mat is severed from the drum by a cut across the mat parallel with the axis of the drum. Thereafter, the condensed mat is deposited on a conveyor belt which moves longitudinally at a very slow pace. The severed condensed mat is generally rectangular in shape and the fibers are continuous for the most part and extend completely across the width of the mat in a direction generally perpendicular to the direction of movement of the conveyor belt.

At the exit end of the conveyor belt, a retarding roller presses the condensed mat against the conveyor belt which is supported by an oppositely rotating support roller. The leading end of the condensed mat beyond the retarding roller is stretched or expanded longitudinally up to 500 or 600 times the original length of the condensed mat. The expanding is a continuing process with the leading end being pulled longitudinally while the confining-retarding roller minimizes the forward movement of the remaining condensed mat.

As the mat is expanded longitudinally, it also fluffs vertically to a consistency somewhat like cotton candy and the transversely extending fibers are pulled longitudinally tending to rotate and reorient the fibers such that they assume a 45° or greater angle with respect to the longitudinal direction as the mat is stretched and necks down to a smaller width.

After the majority of the expanding takes place, the fluffed, expanded mat is rolled to confine it to a thinner mat and it is heated by radiant heaters to set the thermosetting resin incorporated during the deposition of the fibers on the drum. Thereafter, the stretched glass fiber mat is wound on a drum where it may be transported to other locations for use in various embodiments such as heat, thermal and sound insulation and filters as an example.

A patent to Simkins et al., U.S. Pat. No. 2,644,780, defines a similar process which includes stacking a plurality of mats to have a thicker resulting mat for use.

A patent to Copenhefer, U.S. Pat. No. 2,984,286, discloses a glass filament feeding technique which purports to improve the quality of the mat deposited on the drum.

A patent to Schlarb, U.S. Pat. No. 3,072,513, discloses another technique for treating the fibrous mat during its expansion to improve its qualities.

A patent to Beckner, U.S. Pat. No. 3,092,533, discloses an apparatus and process for controlling the thickness of the expanded mat.

What none of these patents disclose is a way of making a continuous series of glass fiber panels from the expanded mat with the mat having a substantial pattern and transverse relief as molded.

SUMMARY OF THE INVENTION

This invention provides a technique for stretching or expanding and molding mats of glass fiber which is not disclosed in the aforementioned patents and not known in the industry.

This invention intends to provide a preform or panel of glass fiber strands where the strands extend completely across the width and length of the preform. Molded preform elements formed from continuous strands are considerably stronger in tension and in maintaining their molded shape than are chopped fibers of the same glass strands. Insofar as is known in the industry at this time, there is no convenient way for a continuous molding process incorporating continuous strands from an expanded mat of fibers originating as a condensed mat as described in the Modigliani patents identified above.

Apparatus of this invention for expanding the condensed mat is conventional with respect to the hold-back features of the condensed mat and the means for maintaining the desired width of the expanded mat. What is different in this invention is the way of expanding the mat longitudinally and it includes a gripping mechanism on the edges of each of a plurality of female molds mounted on a framework. In this invention, expansion will be in the range 100–600 times.

The framework is located downstream of the holdback rollers and mounted to rotate about an axis which is generally perpendicular to the direction of longitudinal expansion of the condensed mat of fibers. In this specific design, the framework is square, one female mold is mounted on each face of the framework and extends between corners. The expanded fibers are advanced and elongated by a gripper on the leading edge of each of the female molds. That is, the framework rotates in a direction to pull the fibrous mat longitudinally away from the retarding rolls engaging the condensed mat. On the leading edge of each of the female molds is a grip which engages the mat and pulls it longitudinally as the frame rotates. The preferred gripping mechanism is a plurality of pins, pegs or prongs which penetrate the fiberglass mat in a direction generally perpendicular to the longitudinal direction of expansion.

Corresponding pins, pegs or prongs are provided in the trailing edge of each female mold and along the side edges extending from the leading edge to the trailing edge. Thereby, the gripping prongs prevent the fibrous mat from being dragged inwardly when a male section of the mold compresses the expanded mat to deform it inwardly to the desired patterned structure. Spacer blocks may be provided along the edges of the molds to prevent excessive compression of the glass fiber mat when it is formed. It is desired that the thickness of the mat be maintained in a range 1/16 to 1 inch thick in its compressed, formed condition. The relief achieved by the molds may exceed about fourteen inches in a transverse direction.

Incorporated within the elongated glass fiber mat is a thermosetting resin which cures or sets at a temperature in the range 300° F. to 750° F. and it is desirable to set the resin with the fibers in the formed condition. Thus it will retain its formed shape after it is removed from between the male and female molds. Thermoplastic resin may be used under certain conditions.

In the preferred embodiment, the heat for setting the thermosetting resin is provided through duct work from a heater to deliver hot air through porous male and female molds and through the porous glass fiber mat for a period of time in the range of about 1 second to 25 seconds and preferably 20 seconds. Thereafter, the male mold is retracted, the framework rotated or indexed forward as the next section of the expanded mat is pulled forward over the next female mold. The molded glass fiber preform is pulled from the mold manually, mechanically or preferably by the fibers extending from the prior molded glass fiber preform which is pulled transversely from the framework by a conveyor belt leading to a blade for severing the fibers between molded preforms.

The result is a patterned panel formed from a flat panel to have a relief of up to fourteen inches.

Objects of the invention not understood from the above description will be fully appreciated upon a review of the drawings and the description of the preferred embodiments which follow.

DETAILED DESCRIPTION OF THE PREFERRED EMBODIMENT

Figure 1:
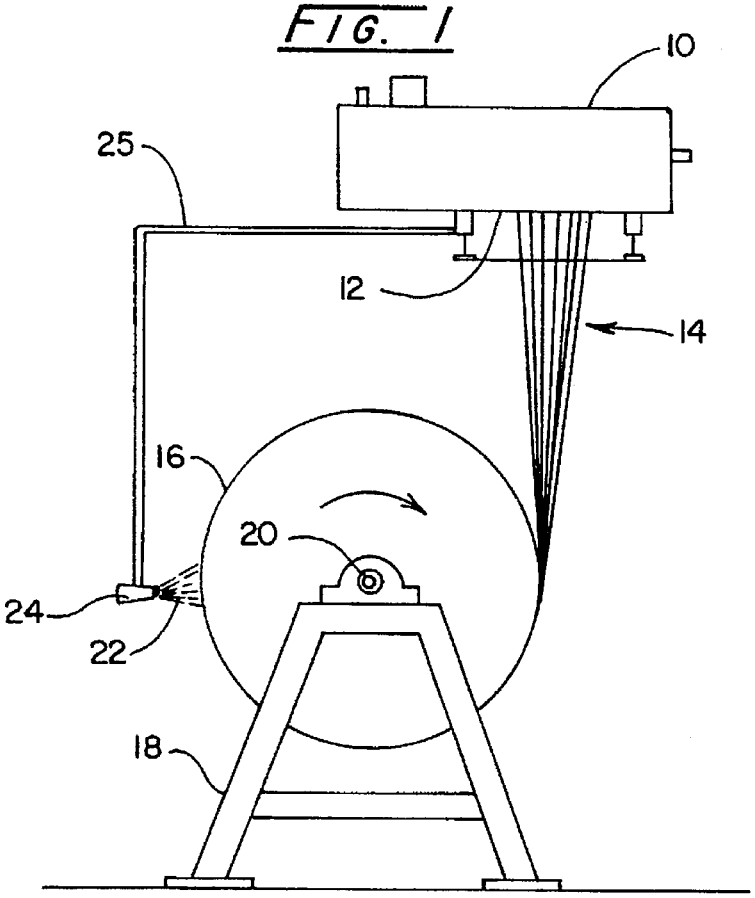
FIG. 1 is a side elevational view of apparatus for forming a condensed mat of glass fibers.

FIG. 1 illustrates schematically the formation of a condensed mat of glass fibers in a partially conventional forming operation generally described in the Modigliani patents described above and in a manner well known in the industry. Glass is delivered in proper condition to a furnace 10 where it is melted and spun from a suitable patterned orifice plate 12 in the form of a plurality of endless glass fibers 14, preferably having a diameter of about 28 microns, which are deposited on a rotating drum 16 supported on a frame 18. In conventional fashion, the furnace and/or orifice plate move back and forth across the surface of the rotating drum which may be several feet in length until a suitable thickness of layers of fiberglass are deposited on the drum 18. Then the condensed mat of glass fibers is cut from the drum by severing the fibers longitudinally along the drum generally parallel with the axis of rotation 20 of the drum. Preferably the mat will have a thickness of about ¼ inch and a density of about 70 lbs/ft$^3$.

During the process for depositing the layers of glass fibers on the drum 16, a thermosetting resin 22 is sprayed from a nozzle 24 in well known fashion. The spraying operation may be by way of hand operation or it may be mechanical. Some prior art procedures describe applying the resin by brush or roller instead of being sprayed from a nozzle. The way the resin is applied in this invention is by a mechanically-computer controlled spray apparatus which is mechanically connected at 25 to move longitudinally with the furnace 10 and orifice plate 12.

In this invention it is desirable that the resin be thermosetting in the temperature range of from about 300°–750° F., preferably about 550°–650° F. and most preferably about 600° F. which will cure in about 1–25 seconds and most preferably 20 seconds. A suitable resin for this purpose is available commercially as a mixture which is water soluble and may be primarily an acrylic resin, phenol formaldehyde, urea-formaldehyde, polyvinyl alcohols, latex and the like. The preferred polyester resin mixture is purchased from McWhorter Technologies Company with the trade designation CARGIL 72-7207 and may be modified to generally have the formula:

65–75% polyester

12–18% isopropyl alcohol 0.8–1.2% trimethyoxysilan-(trademark MEMO from Cook Composites)

0.4–0.8% triethylammonium catalyst (trademark STYPOL 044-0235)

0.4–0.6% trimethylamine

10–15% melamine (trademark RESIMENE 745)

The sequence for mixing the ingredients is well known in the industry and need not be described here.

It should be noted that the temperature of the fibers 14 as they are deposited on drum 16 is below the thermosetting temperature of the suitable resin specified for this invention. The resin is sprayed by air atomization to provide a resin content of about 10% by weight of fibers, plus or minus 5%.

Figure 3:
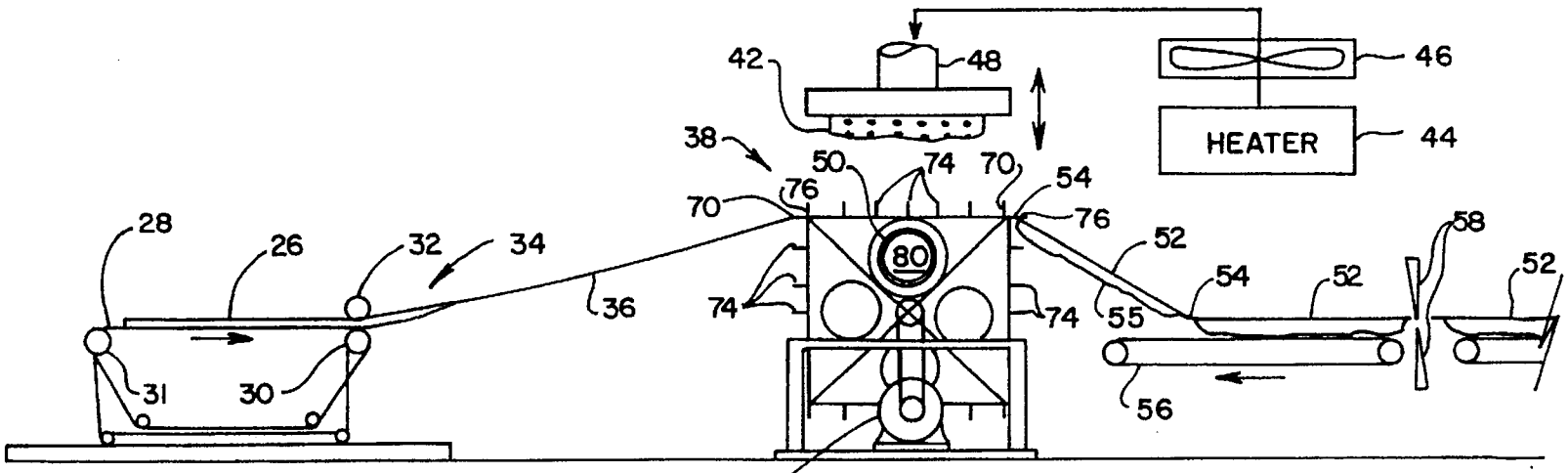
FIG. 3 is a side elevational view of the apparatus of FIG. 2 and including a heater and a blower shown schematically.
Figure 2:
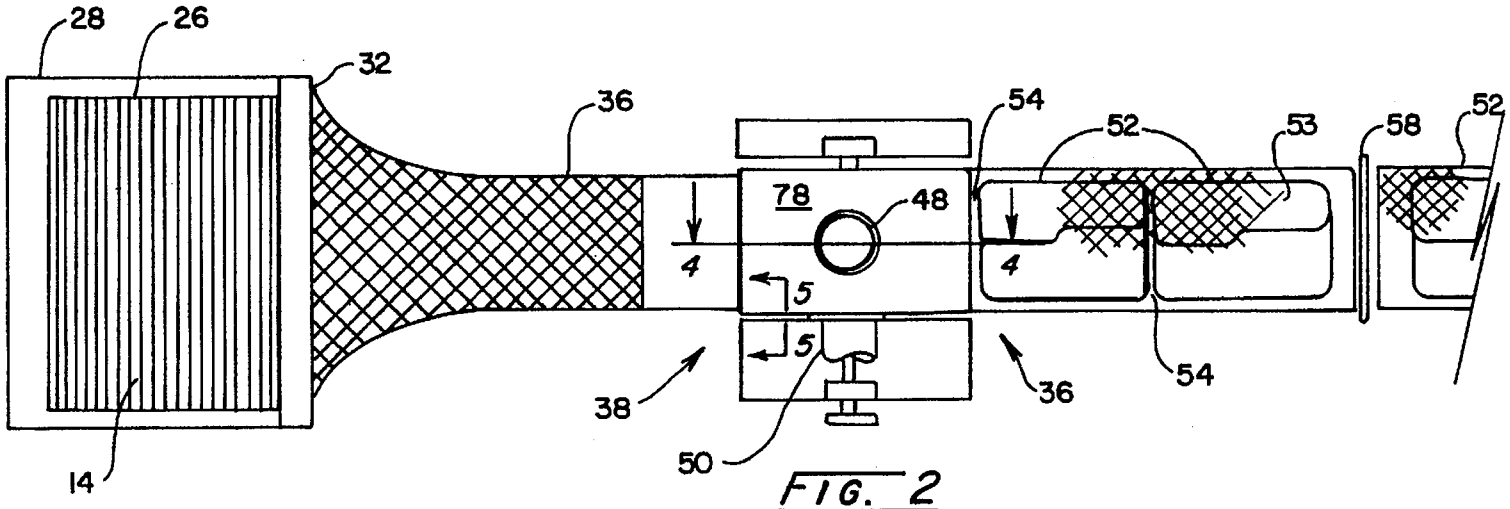
FIG. 2 is a top plan view of the apparatus of this invention for molding a preform from an expanded mat of glass fiber strands expanded from a condensed mat severed from the drum illustrated in FIG. 1, the expanded mat being drawn longitudinally by a rotating frame and formed into preforms by reciprocating mold surfaces.

Looking to FIGS. 2 and 3, the condensed mat 26 stripped from the drum 16 is generally rectangular in shape and is deposited on a conveyor 28 supported on a plurality of rollers 30, 31 which allows the condensed mat to be fed in a direction generally illustrated as from left to right and the speed of advance of the condensed mat 26 is controlled by a retarding roller 32 which pinches the condensed mat and conveyor 28 between it and supporting roller 30. Together rollers 30 and 32 combine to serve as holdback rollers in the mat expansion process.

In conventional fashion, the fibers 14 in the condensed mat 26 extend essentially perpendicular to the longitudinal direction of movement of conveyor 28. There is a slight acute angle between layers of fibers 14, but for purposes of the inventive concept they are almost parallel with each other.

In conventional fashion, when the expanding mat exits the pinch area between rollers 30 and 32 the mat fluffs vertically as at 34 in FIG. 3, necks down to a narrower width as illustrated in FIG. 2, and the expansion of up to 100–600 times (or more) the original longitudinal length of condensed mat 26 tends to reorient the fibers to an angle of 45°, 60° or even greater degree between layers, depending on the magnitude of the expansion, somewhat as is illustrated schematically in FIG. 2. Notwithstanding the expansion and the reorientation of the fibers, the strands extend generally completely across the full width of the expanded mat. The reason this is desirable for the subsequent molding procedure is that continuous or essentially completely continuous strands provide greater strength in tension, structural durability and retention of shape than chopped glass fibers which may be molded to the same shape as will be described subsequently. Accordingly, the continuous strand mat of this invention is far superior to the panels formed of chopped strands of glass fibers.

A mechanism for maintaining a suitable width for the expanded mat 36 is conventional and need not be described herein. Preferably the degree of expansion and subsequent formation will provide a panel with a weight of about 0.25–4 oz./ft$^2$.

Figure 4:
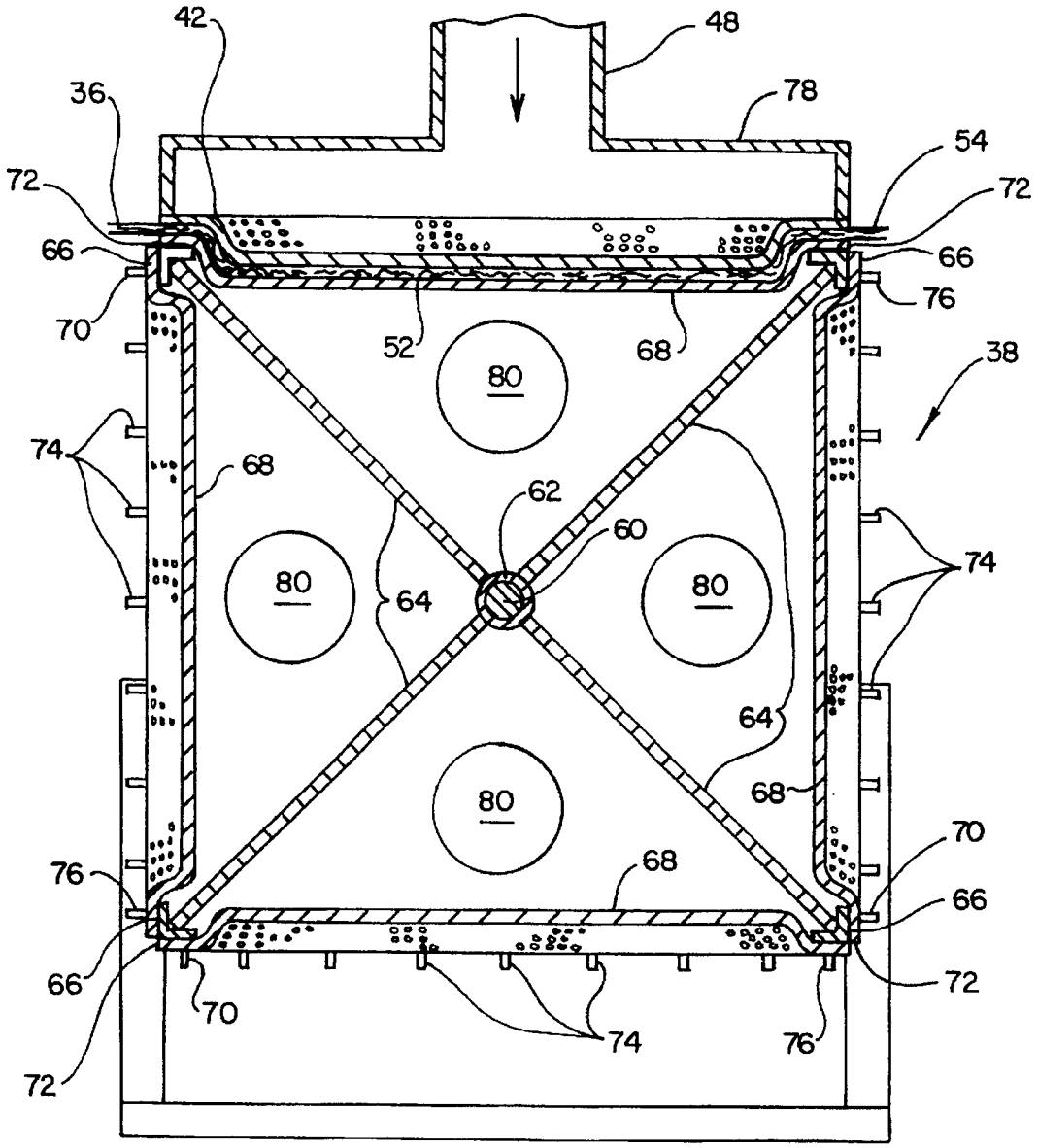
FIG. 4 is a fragmentary sectional view taken along line 4—4 of FIG. 2.

A suitable distance downstream from retarding rollers 30, 32, is a framework 38 which is best seen in FIG. 4 and will be described in detail subsequently. Expanded mat 36 is drawn longitudinally by a gripper on the leading end of a female mold 68 mounted on each face of the square framework illustrated in FIG. 3. It is indexed forward in clockwise direction by a programmed motor 40.

Each female mold mounted in the framework is rotated to a location suitable for mating with a male mold 42 which is mounted to reciprocate into and out of mating relationship with one of the female molds in the framework 38.

Male mold 42 is connected in fluid relationship with a heater 44 which heats air to a temperature suitable for curing thermosetting resin incorporated in the expanded mat 36. Hot air from heater 44 is driven by blower 46 through a duct work 48 to male mold 42. The hot air passes through the perforated surface of male mold 42, through the glass fiber mat 36, through a similarly perforated female mold 68 and is discharged from the framework through one of a plurality of ports 80 leading to a duct 50.

Preforms 52 resulting from formation of expanded mat 38 between male 42 and female 68 molds and thermosetting heat from the heater 44 are extracted from the molds when the male mold 42 is retracted and the motor 40 indexes or rotates the framework 38 forward in a clockwise direction. Each preform or formed panel 52 is connected with the next prior preform by connecting glass fiber strands which serve as a bridge 54 to assist the leading preform in pulling the trailing preform from the female mold with an assist from a conveyor belt 56. After formation, each preform 52 includes a recessed face 53 and a projecting face 55.

It will be understood that the conveyor belt 56 is an optional feature. The preforms 52 may be extracted from the female mold by any mechanism desirable, but in this, the preferred embodiment, the bridging strands 54 serve to drag the trailing preform along until it arrives at a severing blade 58.

Figure 5:
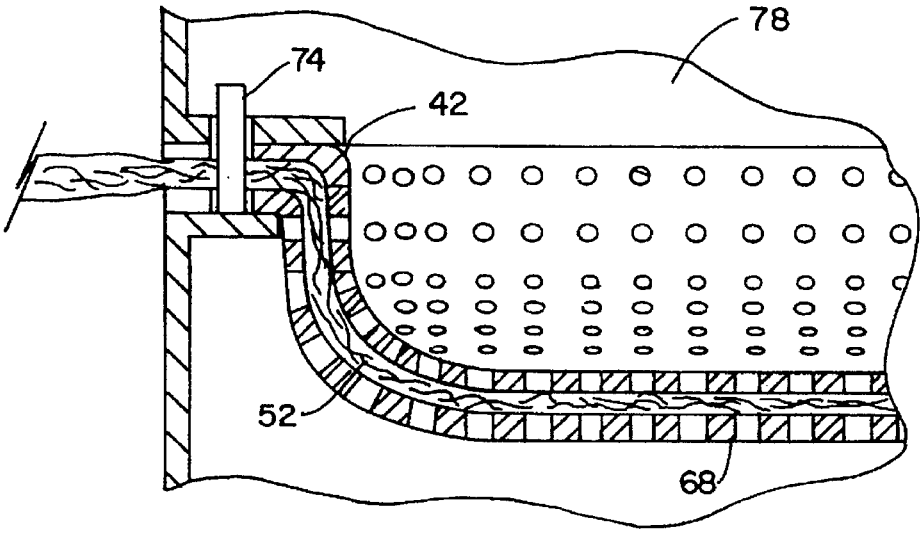
FIG. 5 is a fragmentary sectional view of closed molds according to this invention taken along line 5—5 of FIG. 2.

Looking now to FIGS. 4 and 5, the framework 38 is mounted to rotate about an axis 60 of an axle 62 having spokes 64 extending radially therefrom. Spokes 64 support transversely extending angle irons 66 which in turn support the four porous female molds 68.

It should be emphasized that in the preferred embodiment the female molds are mounted on the four sides of the framework 38, but it should be equally clear that the female molds could be replaced by the male molds 42. This operation lends itself more favorably to the male/female mold relationship illustrated since an upwardly projecting male mold might make it more difficult for the gripping prongs 70 on the leading edge 72 of the female molds to penetrate the leading end of the expanded mat 36, expand it and elongate it to pull it longitudinally forward away from retarding rollers 30, 32. Should the male mold 42 be mounted in the framework 38, the upwardly projecting portion might tend to push the leading edge of the penetrated fibrous mat 36 away from the mold surface and cause it to disengage from gripper 70. This result is easily overcome by elongating prongs 70, 74 and 76.

In this particular operation, the female mold 68 is preferably mounted on the framework as shown.

It will further be observed that prongs 74 projecting upwardly from the side edges of each female mold 68 and similar prongs 76 projecting outwardly from the trailing end of each female mold cooperate with prongs 70 during the molding process to hold the edges of the glass fibers against being dragged into the central part of the mold when the male mold presses and forms the fiberglass into the female mold.

In operation, the condensed mat 26 is expanded in conventional fashion and directed to a framework 38 where it is engaged by a gripper mechanism 70 at the leading end of each female mold 68. When the framework 38 is rotated to a suitable position for reciprocally engaging a male mold 42 in mating fashion, it stops. Male mold 42 descends as illustrated in FIG. 3 to a position shown in FIGS. 4 and 5. This compresses and forms the expanded mat 36 to the shape of a preform 52 of a specified thickness of 1/16 to 1 inch thick and a degree of relief from a horizontal surface to the greatest depression or formation of possibly over fourteen inches. Greater deformation tends to cause separation and thinning of the preform 52 at unspecified locations within the preform 52 and in particular, where the prongs or gripping devices engage the preform.

After the male mold descends to the degree desired, its downward movement is minimized by spacer blocks (not shown) to insure the proper thickness of the preform, a blower 46 is activated to blow hot air from heater 44 through duct work 48 at a suitable temperature to a plenum chamber 78 and the hot air is delivered to the plenum chamber 78 for a period of 1–25 seconds which is adequate to cure the thermosetting resin 22 incorporated within the preform 52. The hot air passes into the plenum chamber, through the porous male mold 42, through the fibrous material of the preform 52 and out of the female mold 68 between the spokes 64 where it is discharged transversely through a port or opening 80.

After the preform 52 is cured such that it will retain its shape, male mold 42 is retracted and the framework 38 is rotated or indexed forward by motor 40. Bridge strands 54 extending between preforms pull the just-formed preform 52 from the female mold 68. The leading edge prongs 70 on the next advancing female mold grip, pull and further expand the expanded mat 36 into position for the next molding procedure.

The extracted preforms 52 are deposited automatically on conveyor belt 56 and delivered to cutting blades 58 where each preform is severed from the other and then may be stacked in nested fashion (not shown) for shipment to another location for incorporation into a finished product. For example, the particular preform illustrated in FIG. 2 may be trimmed and incorporated as a part of an automobile door. It should be noted that preform 52 may have a generally rectangular periphery or a non-rectangular periphery as needed. Blades 58 may be structured to perform a more elaborate trimming function if desired.

Having thus described the invention in its preferred embodiment, modifications to the structure and the procedural steps will be obvious to those having ordinary skill in the art. Accordingly, it is not intended that the invention be limited by the description of the preferred embodiment nor the drawings illustrating the same. Rather, it is intended that the invention be limited only by the scope of the appended claims.

We claim:

1. A process for making a glass fiber panel comprising:

providing a generally rectangular condensed mat of glass fibers and a thermosetting resin, said mat having a length, a width and a thickness, at least some of said fibers extending the width of said condensed mat, expanding said condensed mat longitudinally in a direction generally perpendicular to the width of said condensed mat and reorienting said fibers to form an expanded mat, delivering a portion of said expanded mat to a framework having an axis of rotation which is generally perpendicular to the direction of longitudinal expansion of the condensed mat of said glass fibers and having a plurality of female molds mounted on said framework for rotation therewith, each of said plurality of female molds having a leading edge, side edges, and a trailing edge; each said leading edge, trailing edge, and side edges having prongs projecting therefrom, said prongs engaging and gripping said expanded mat to longitudinally pull and further expand and position said expanded mat intermediate a male mold and one female mold of said plurality of female molds during said rotation of said framework about said axis, bringing said male mold and said one female mold together to confine said portion therebetween and pushing said portion with said male mold to deform an upper surface and a lower surface of said portion in a direction transverse to all said mold edges to form a deformed portion having a deformed shape with a panel thickness, heating said deformed portion intermediate said male mold and said one female mold to set said resin and cause said deformed portion to retain said deformed shape, maintaining said male mold and said one female mold stationary with respect to said deformed portion during said heating step; and severing said deformed portion from said expanded mat to define said panel.

2. The process of claim 1 wherein said male mold and said plurality of female molds have pores; said heating step including passing hot air in through said pores of said male mold, into said deformed portion and out through said pores of said one female mold.

3. The process of claim 2 wherein said hot air is produced by heating air to a temperature in the range of about 300° F. to about 750° F. prior to passing said hot air through said male mold and said one female mold and said deformed portion.

4. The process of claim 1 wherein in a closed position said male mold and said one female mold fit together with all edges spaced apart and in resister, said one female mold and said male mold also having a spaced apart distance in said closed position to define said panel thickness for said deformed portion, said male mold projecting into said one female mold for a distance greater than said spaced apart distance when said male mold and said one female mold are in said closed position, said pushing step comprising said male mold pushing said portion of said expanded mat transverse to said longitudinal direction for a distance greater than said panel thickness of said deformed portion.

5. A process for making a glass fiber panel comprising:

providing a generally rectangular condensed mat of glass fibers and a thermosetting resin, said mat having a length, a width and a thickness, at least some of said fibers extending the width of said condensed mat, expanding said condensed mat longitudinally in a direction generally perpendicular to the width of said condensed mat and reorienting said fibers to form an expanded mat, delivering a portion of said expanded mat to a framework having an axis of rotation which is generally perpendicular to the direction of longitudinal expansion of the condensed mat of said glass fibers and having a plurality of male molds mounted on said framework for rotation therewith, each of said plurality of male molds having a leading edge, side edges, and a trailing edge; each said leading edge, trailing edge, and side edges having prongs projecting therefrom, said prongs engaging and gripping said expanded mat to longitudinally pull and further expand and position said expanded mat intermediate a female mold and one male mold of said plurality of male molds during said rotation of said framework about said axis, bringing said female mold and said one male mold together to confine said portion therebetween and pushing said portion with said female mold to deform an upper surface and a lower surface of said portion in a direction transverse to all said mold edges to form a deformed portion having a deformed shape with a panel thickness, heating said deformed portion intermediate said female mold and said one male mold to set said resin and cause said deformed portion to retain said deformed shape, maintaining said female mold and said one male mold stationary with respect to said deformed portion during said heating step; and severing said deformed portion from said expanded mat to define said panel.

6. The process of claim 5 wherein said female mold and said plurality of male molds have pores; said heating step including passing hot air in through said pores of said female mold, into said deformed portion and out through said pores of said one male mold.

7. The process of claim 6 wherein said hot air is produced by heating air to a temperature in the range of about 300° F. to about 750° F. prior to passing said hot air through said female mold, said one male mold and said deformed portion.

8. The process of claim 5 wherein in a closed position said female mold and said one male mold fit together with all edges spaced apart and in register, said one male mold and said female mold also having a spaced apart distance in said closed position to define said panel thickness for said deformed portion, said one male mold projecting into said female mold for a distance greater than said spaced apart distance when said female mold and said one male mold are in said closed position, said pushing step comprising said female mold pushing said portion of said expanded mat transverse to said longitudinal direction for a distance greater than said panel thickness of said deformed portion.

* * * * *